US007530925B2

(12) United States Patent
Underwood

(10) Patent No.: US 7,530,925 B2
(45) **Date of Patent: *May 12, 2009**

(54) PORTABLE JUMP TRAINING APPARATUS

(75) Inventor: Bradford J. Underwood, Columbus, OH (US)

(73) Assignee: Sports Imports, Inc., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/779,939

(22) Filed: Jul. 19, 2007

(65) Prior Publication Data

US 2009/0023557 A1 Jan. 22, 2009

(51) Int. Cl.
*A63B 5/00* (2006.01)

(52) U.S. Cl. ..... 482/15; 482/148

(58) Field of Classification Search ..... 482/14, 482/15, 148, 8, 83–90
See application file for complete search history.

(56) References Cited

U.S. PATENT DOCUMENTS

| | | | | |
|---|---|---|---|---|
| 2,469,145 | A * | 5/1949 | Baliff | 482/148 |
| 2,697,603 | A | 12/1954 | Haines | |
| 3,012,781 | A | 12/1961 | Nelson | |
| 3,258,266 | A | 6/1966 | Kamish | |
| 3,534,956 | A | 10/1970 | Myers | |
| 3,690,664 | A | 9/1972 | Hauke | |
| 3,795,396 | A | 3/1974 | Kropelnitski | |
| 4,208,050 | A | 6/1980 | Perrine et al. | |
| 4,344,628 | A | 8/1982 | Warehime | |
| 5,031,903 | A * | 7/1991 | Clarke | 482/148 |
| 5,072,931 | A * | 12/1991 | Carlson | 482/15 |
| 5,209,713 | A | 5/1993 | Brown et al. | |
| 7,097,589 | B2 | 8/2006 | Underwood et al. | |
| 2005/0202935 | A1 * | 9/2005 | Underwood et al. | 482/15 |

* cited by examiner

*Primary Examiner*—Jerome Donnelly
(74) *Attorney, Agent, or Firm*—Michael J. Gallagher, Esq.; David J. Dawsay, P.E., Esq.; Gallagher & Dawsey Co., LPA

(57) ABSTRACT

A portable jump training apparatus designed for portability that permits an athlete to safely measure their vertical leap in any number of venues where a jump training apparatus might be utilized is provided. The portable jump training apparatus may include a jump measurement device, a height adjustment post, and an external surface mount. The height adjustment post may be joined to the jump measurement device such that they are positionally fixed with respect to one another. The external surface mount may include at least one adjustable gripping device to releasably secure the external surface mount to an external mounting surface. Also, the external surface mount may include a translation guide configured for translational cooperation with the height adjustment post such that the position of the jump measurement device may be adjusted with respect to the stationary external surface mount.

16 Claims, 7 Drawing Sheets

PORTABLE JUMP TRAINING APPARATUS

TECHNICAL FIELD

The present invention relates to the field of jump training devices, in particular, to a portable jump training apparatus that may be releasably secured to an external mounting surface, such as a basketball backboard, to measure an athlete's vertical leap.

BACKGROUND OF THE INVENTION

An athlete's vertical leaping ability is one of the most important indications of overall athletic ability. This attribute is closely evaluated in many of today's major sports. For example, the National Football League and the National Basketball Association each hold pre-draft combines for future prospects in which the prospect's vertical leaping ability is tested. Recognizing the importance of the vertical leap, athletes now train diligently to improve their leaping ability. Accordingly, devices that accurately measure an athlete's vertical leap are in demand.

Prior art jump trainers have failed to feature a device that is safe to use, compact, and readily portable. Many of the prior art jump trainers do not provide adequate safety features to minimize the risk of an athlete being injured while measuring their vertical leap. One common problem with early jump trainers was that they were prone to tip over and cause injury to the athlete or coach. This problem was addressed in Applicant's U.S. Pat. No. 7,097,589 (the '589 patent) by providing a wall-mounted jump training apparatus having several safety features.

Yet another drawback associated with conventional jump trainers is that they occupy a great deal of floor space and are not easily stored. In many cases the jump trainer will be stored near the vicinity it is typically used. Such jump trainers can be a substantial hazard to a player chasing a ball out of bounds. Again, this problem was addressed in Applicant's '589 patent, as well as other wall-mounted jump training devices.

Still another problem associated with modern jump training devices is that they are typically designed to remain in one general area, for example, a gymnasium or similar athletic facility. Many of the jump training devices utilize parts that are very long and not easily transportable. Of course, all wall mounted jump training devices are typically designed to be non-portable.

A compact, portable jump training device would provide a team or individual athlete with the ability to transport the device to any athletic facility where they wanted to test, or work on, their leaping ability. Moreover, it is highly unlikely that every athletic facility has a jump training device. By providing a compact, portable jump training device a team or individual athlete would not have to depend on a particular facility having a jump training device.

Accordingly, the art has a need for a jump training apparatus that is safe, easy to use, compact, and readily portable to any number of venues where a jump training apparatus might be utilized.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The portable jump training apparatus of the present invention is designed for portability and permits an athlete to safely measure their vertical leap in any number of venues where a jump training apparatus might be utilized. The apparatus is compact and lightweight, yet very rigid and durable. The apparatus may be mounted to various external mounting surfaces, such as a basketball backboard, a football goal post, and other sufficiently elevated fixed supports.

The portable jump training apparatus of the present invention generally includes a jump measurement device, a height adjustment post, and an external surface mount, as well as various safety features. Briefly, the primary safety features include a height adjustment lock to adjustably secure the height of the jump measurement device, a translation lock to control translation of the height adjustment post when the height adjustment lock is disengaged, and a limit lock to prevent the height adjustment post and jump measurement from falling to the ground when the height adjustment lock is disengaged.

The jump measurement device of the present invention includes a plurality of vanes rotatably mounted to a vane mounting post. In use, an athlete's standing reach is first measured, and then the athlete jumps vertically and slaps the vanes so that they rotate about the mounting post, thereby providing an indication of the maximum height that the athlete achieved. The vanes are installed such that they are under compression, thereby providing some resistance to rotation and reducing the likelihood that the vanes ever rotate a full revolution. However, to ensure that over time the vanes do not become loose and freely rotate, a vane stop may be incorporated to stop the vanes at a predetermined location. The vane stop serves as a positive stop ensuring an athlete's hand and arm are not injured by a rapidly rotating vane.

The height adjustment post is joined to the jump measurement device such that the jump measurement device and the height adjustment post are positionally fixed with respect to one another to form a single, adjustable part. Therefore, when adjustments are made to the height adjustment post, the jump measurement device is correspondingly adjusted. In one embodiment, the jump measurement device may include a frame member having a vertical post and at least one support arm that is joined to the vane mounting post.

The external surface mount includes at least one adjustable gripping device to releasably secure the external surface mount to the external mounting surface. In one embodiment, the external surface mount may include at least two adjustable gripping devices with at least one adjustable gripping device located near a distal end of the external surface mount, and at least one adjustable gripping device located near a proximal end of the external surface mount.

The external surface mount also includes a translation guide configured for translational cooperation with the height adjustment post. The translational cooperation between the translation guide and the height adjustment post allows the position of the jump measurement device and the height adjustment post to be adjusted with respect to the stationary external surface mount. In one embodiment, the translational cooperation may be accomplished by configuring the translation guide to slidably receive the height adjustment post within the translation guide. In an alternative embodiment, the translational cooperation may be accomplished by configuring the height adjustment post to translate about the translation guide instead of within the translation guide.

In one embodiment, the height adjustment post is joined to the vertical post and is spaced apart from the vertical post a post separation distance. The post separation distance allows the jump measurement device to translate adjacent an outer surface of the translation guide as the height adjustment post translates within the translation guide.

The height adjustment post may be joined to the vertical post by a number of effective methods, including, but not limited to mechanical fasteners, welding, or a locking sleeve. The locking sleeve may be welded, or otherwise joined, to the height adjustment post, and is configured to receive and releasably lock the vertical post in position. In embodiments where the height adjustment post is joined to the vertical post by mechanical fasteners or welding, the translation guide should be formed with a slot appropriately sized to receive the screws, bolts or welded material to enable the jump measurement device to translate adjacent an outer surface of the translation guide.

In another embodiment, a vertical post may not be required for joining the jump measurement device to the height adjustment post. Instead, the jump measurement device may have at least one support arm, wherein the height adjustment post is joined directly to the at least one support arm. The height adjustment post may be joined to the at least one support arm by any of the effective methods discussed above. Thus, in this particular embodiment, the translation guide should be configured to allow the at least one support arm to translate freely with the height adjustment post. This may be accomplished by forming the translation guide with a slot such that the translation of the jump measurement device corresponds to the translation of the height adjustment post within the translation guide.

In an alternative embodiment of the instant invention, the height adjustment post may be configured to translate external to the translation guide instead of within the translation guide. In this embodiment, the translation guide is joined to, yet spaced apart from, the external surface mount. To enable translation of the height adjustment post about the translation guide, the height adjustment post may be formed with a slot. The slot begins at a proximal end of the height adjustment post and terminates near a distal end of the height adjustment post. However, the slot does not extend all the way to the distal end.

The instant invention enables a significant advance in the state of the art. The instant invention is, in addition, widely applicable to a large number of applications. Variations, modifications, alternatives, and alterations of the various embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The portable jump training apparatus (50) of the instant invention enables a significant advance in the state of the art. The preferred embodiments of the apparatus accomplish this by new and novel arrangements of elements that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
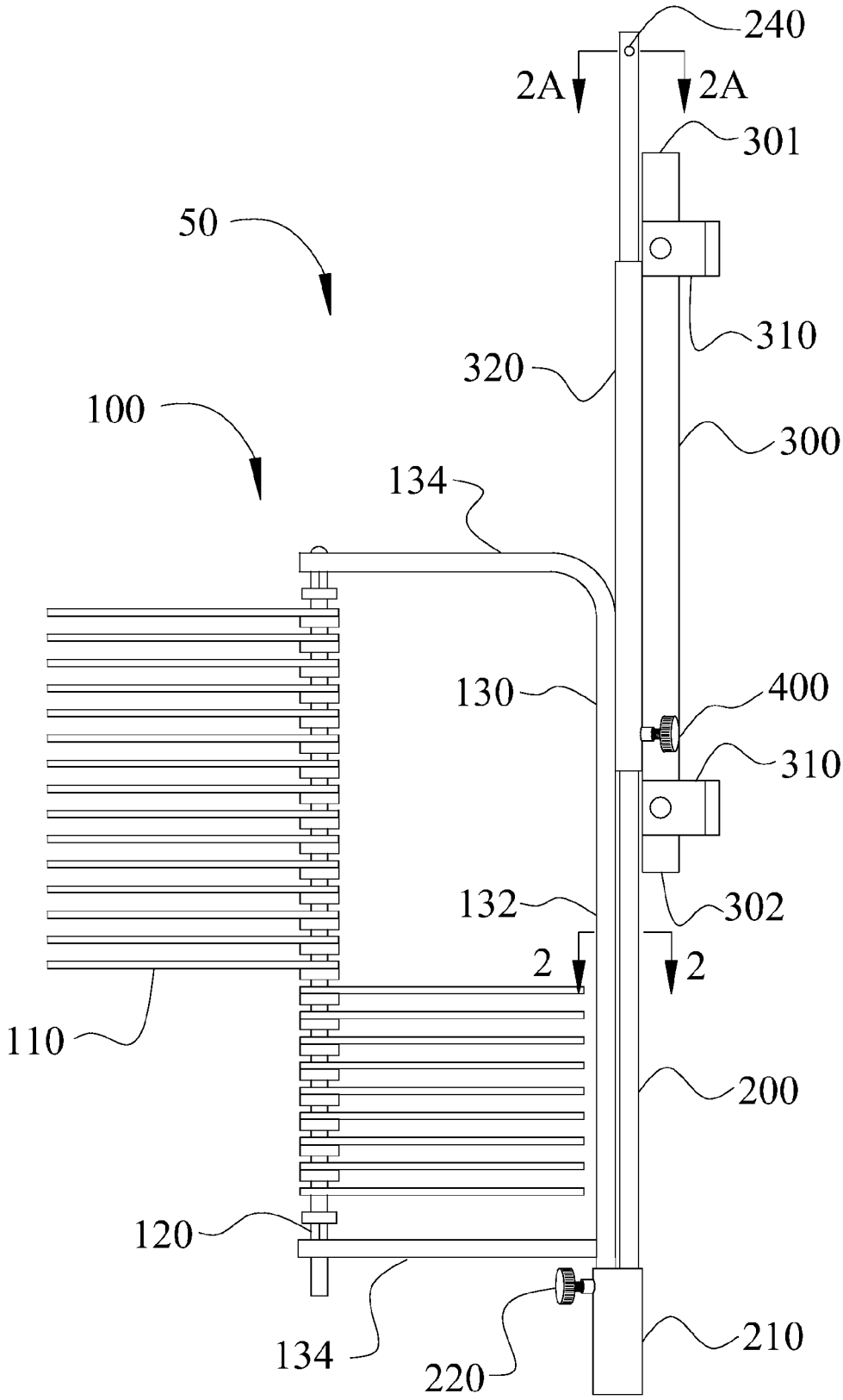
FIG. 1 shows an elevation view of an embodiment of the portable jump training apparatus, not to scale.
Figure 12:
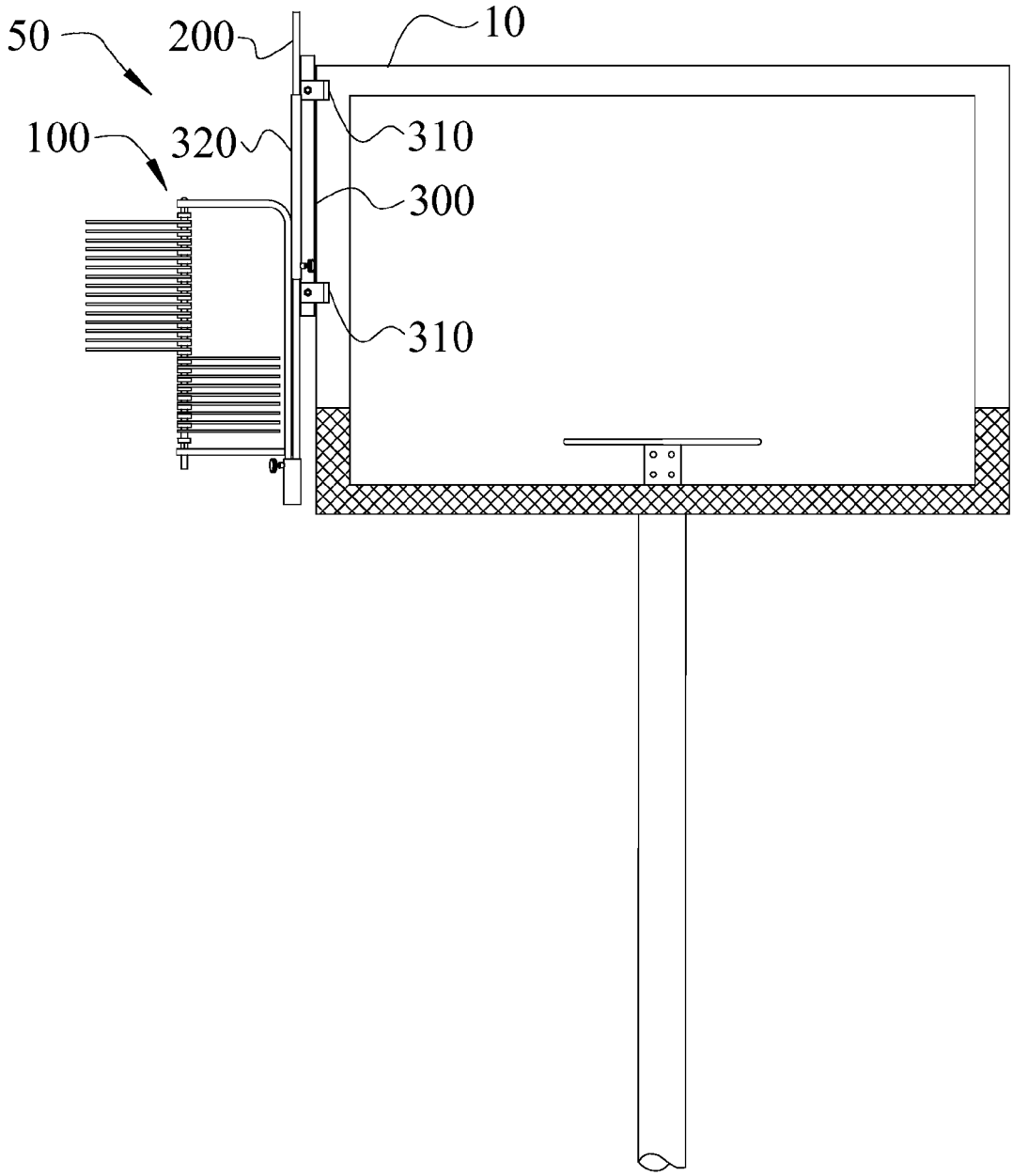
FIG. 12 shows an elevation view of an embodiment of the portable jump training apparatus mounted to a basketball backboard, not to scale.

Referring generally to FIGS. 1 and 12, the portable jump training apparatus (50) of the present invention is configured to be releasably secured to an external mounting surface (10), such as a basketball backboard. The portable jump training apparatus (50) generally includes a jump measurement device (100), a height adjustment post (200), and an external surface mount (300). It should be noted that although the term "post" is used herein, one with skill in the art would recognize that a rod, stake, or other type of longitudinal support of virtually any cross-sectional geometry may be used.

As seen in FIG. 1, the jump measurement device (100) of the present invention includes a plurality of vanes (110) rotatably mounted to a vane mounting post (120). In use, an athlete's standing reach is first measured, and then the athlete jumps vertically and slaps the vanes (110) so that they rotate about the mounting post (120), thereby providing an indication of the maximum height that the athlete achieved. The vanes (110) may be installed such that they are under compression, thereby providing some resistance to rotation and reducing the likelihood that the vanes (110) ever rotate a full revolution. However, to ensure that over time the vanes (110) do not become loose and freely rotate, a vane stop may be incorporated to stop the vanes (110) at a predetermined location. The vane stop serves as a positive stop ensuring an athlete's hand and arm are not injured by a rapidly rotating vane (110).

Still referring to FIG. 1, the height adjustment post (200) may be joined to the jump measurement device (100) such that the jump measurement device (100) and the height adjustment post (200) are positionally fixed with respect to one another to form a single, adjustable part. Therefore, when adjustments are made to the height adjustment post (200), the jump measurement device (100) is correspondingly adjusted.

With reference now to FIGS. 1 and 12, the external surface mount (300) has at least one adjustable gripping device (310) to releasably secure the external surface mount (300) to the external mounting surface (10). In the embodiments shown in FIGS. 1 and 4, the external surface mount (300) includes two adjustable gripping devices (310), wherein at least one adjustable gripping device (310) is located near a distal end (301) of the external surface mount (300), and at least one adjustable gripping device (310) is located near a proximal end (302) of the external surface mount (300). Although the external surface mount (300) is shown as having two adjustable gripping devices (310), one with skill in the art would recognize that only one adjustable gripping device (310) or more than two adjustable gripping devices (310) may be successfully utilized.

Figure 5:
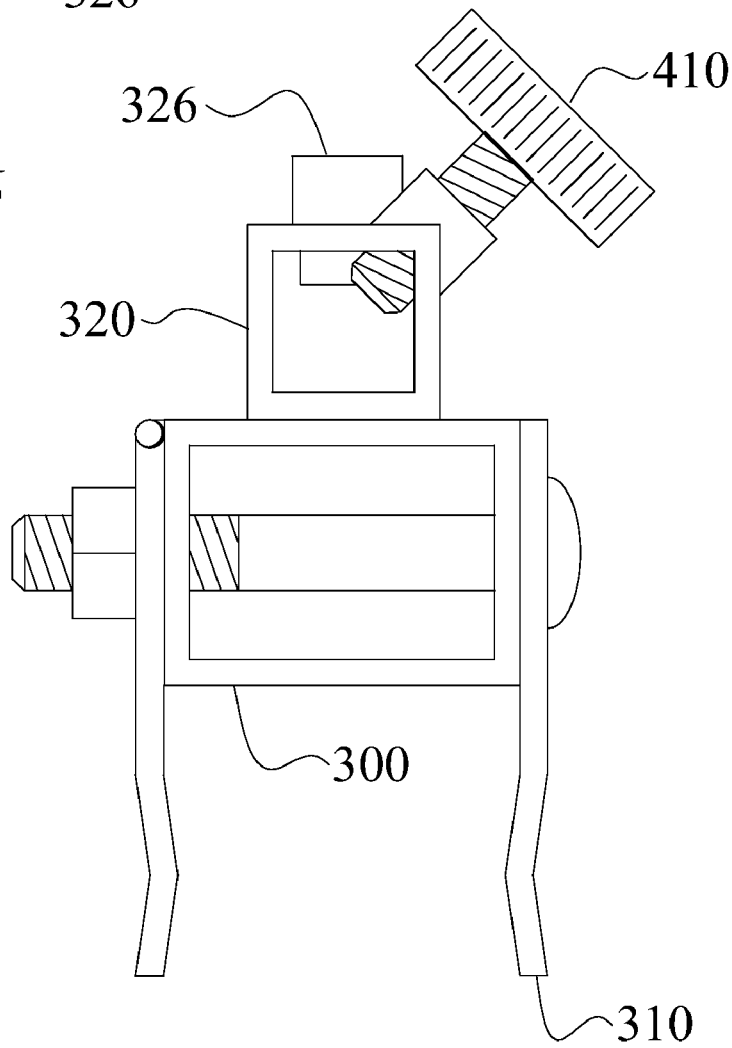
FIG. 5 shows a bottom elevation view of an embodiment of the external surface mount, not to scale.

In one embodiment, the adjustable gripping device (310) may be a hinge clamp that is compressed by tightening a nut on a threaded bolt to releasably secure the external surface mount (300) to the external mounting surface (10). As seen in FIG. 5, the adjustable gripping device (310) is in a completely compressed position, which corresponds to a minimum thickness to which the adjustable gripping device (310) may be adjusted. However, the adjustable gripping device (310) may be virtually any type of clamping device including, but not limited to, c-clamps, spring clamps, and other types of adjustable clamping devices, such as a clamp similar to the Thomas® 3-Prong Dual Adjustable Clamp.

In an alternative embodiment, the adjustable gripping device (310) may be a threaded U-bolt that is drawn into tight positive engagement with an external mounting surface (10) to releasably secure the external surface mount (300). This embodiment is particularly well suited for releasably mounting the portable jump training apparatus (50) to an external mounting surface (10) having a circular cross-section, such as a pole, football goal post, or soccer goal.

It is contemplated that the adjustable gripping device (310) may be detachable from the external surface mount (300). A detachable adjustable gripping device (310) would provide the user with several mounting options depending on which adjustable gripping device (310) is best suited for the particular type of external mounting surface (10) available.

Figure 3:
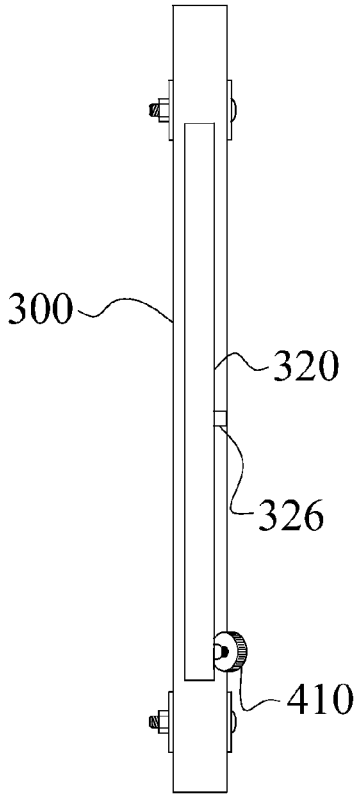
FIG. 3 shows a side elevation view of an embodiment of the external surface mount, not to scale.
Figure 4:
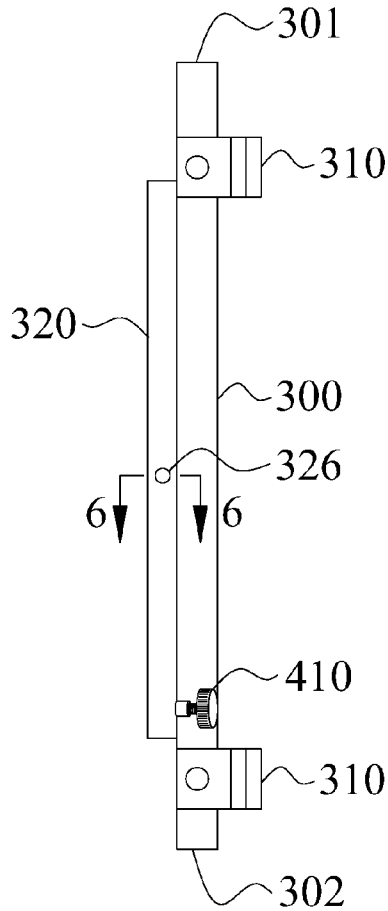
FIG. 4 shows an elevation view of an embodiment of the external surface mount, not to scale.

Referring now to FIGS. 3-5, the external surface mount (300) may include a translation guide (320) configured for translational cooperation with the height adjustment post (200). The translational cooperation between the translation guide (320) and the height adjustment post (200) allows the position of the jump measurement device (100) and the height adjustment post (200) to be adjusted with respect to the stationary external surface mount (300). It is contemplated that the external surface mount (300) and the translation guide (320) could be configured as one piece. In this particular embodiment, the external surface mount (300) is formed as a tube designed to receive the height adjustment post (200) such that the external surface mount (300) also functions as the translation guide (320).

Figures 10, 11:
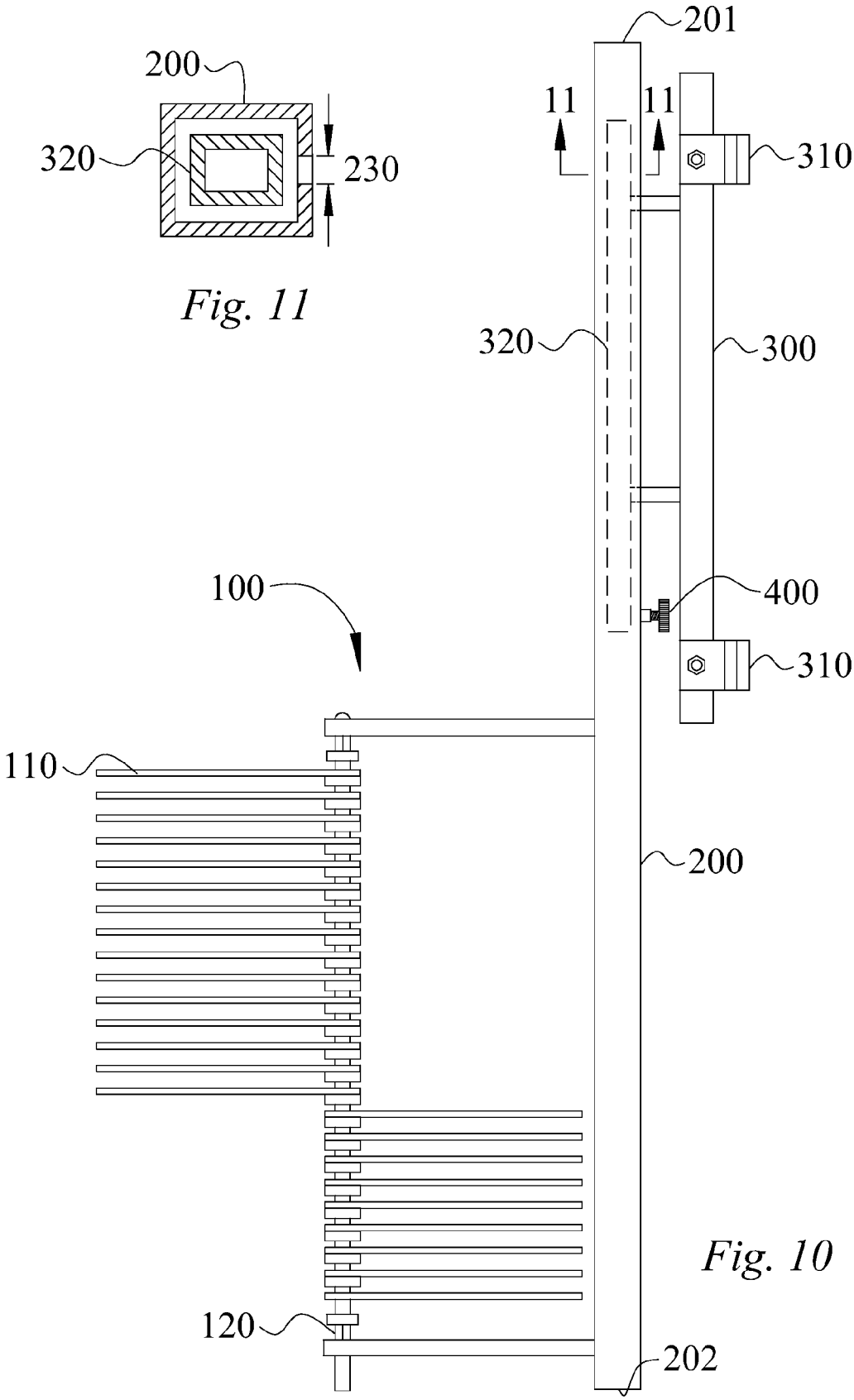
FIG. 10 shows an elevation view of an embodiment of the portable jump training apparatus, not to scale.
FIG. 11 shows a partial cross-sectional view taken along line 11-11 in FIG. 10, not to scale.

As seen in FIG. 1, in one embodiment, the translational cooperation may be accomplished by configuring the translation guide (320) to slidably receive the height adjustment post (200) within the translation guide (320). However, in another embodiment, as seen in FIGS. 10-11, the translational cooperation may be accomplished by configuring the height adjustment post (200) to translate about the exterior surface of the translation guide (320) instead of within the translation guide (320).

In one embodiment, as seen in FIG. 1, the jump measurement device (100) includes a frame member (130) having a vertical post (132) and at least one support arm (134), wherein the vane mounting post (120) is joined to the at least one support arm (134). Although FIG. 1 shows the jump measurement device (100) having two support arms (134), one with skill in the art would recognize that one support arm (134), or more than two support arms (134) may be utilized.

Figure 2:
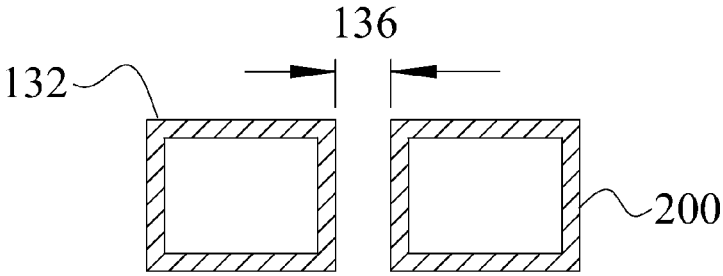
FIG. 2 shows a partial cross-sectional view taken along line 2-2 in FIG. 1, not to scale.

In one particular embodiment, the height adjustment post (200) is joined to the vertical post (132) and is spaced apart from the vertical post (132) a post separation distance (136), which is best seen in FIG. 2. The post separation distance (136) allows the jump measurement device (100) to translate adjacent an outer surface of the translation guide (320) as the height adjustment post (200) translates within the translation guide (320). The translation guide (320) may be configured as a tube with a tube wall thickness (324) to slidably receive the height adjustment post (200). To ensure that the jump measurement device (100) is allowed to properly translate adjacent an outer surface of the translation guide (320), the post separation distance (136) may be approximately 1.05 to 1.25 times greater than the tube wall thickness (324). Having a post separation distance (136) that results in the vertical post (132) nearly touching the translation guide (320) gives the portable jump training apparatus (50) more rigidity and torsional stability, which is more desirable than an apparatus that is loose and unstable.

In another embodiment, the height adjustment post (200) may be formed with an exterior friction reducing surface and the translation guide (320) may be formed with an interior friction reducing surface. These friction reducing surfaces, such as a Teflon coating, help promote smooth translation between the height adjustment post (200) and the translation guide (320) by decreasing the coefficient of friction between the height adjustment post (200) and the translation guide (320).

Figure 7:
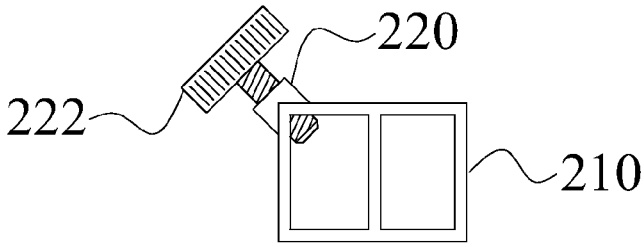
FIG. 7 shows a bottom elevation view of an embodiment of the locking sleeve, not to scale.

The height adjustment post (200) may be joined to the vertical post (132) by a number of effective methods, including, but not limited to, mechanical fasteners (e.g., screws or bolts), welding, or a locking sleeve (210). An embodiment of a locking sleeve (210) is illustrated in FIGS. 1 and 7. The locking sleeve (210) may be welded, or otherwise joined (e.g., by bolts, rivets, screws, and the like), to the height adjustment post (200) or to the jump measurement device (100). Additionally, the locking sleeve (210) may be a separate component that is releasably joined to either the height adjustment post (200) or the jump measurement device (100), or to both the height adjustment post (200) and the jump measurement device (100). In the illustrated embodiment, the locking sleeve (210) is configured to receive and releasably lock the vertical post (132). In order to releasably lock the vertical post (132) in position, the locking sleeve (210) may include a vertical post lock (220), which may include a setscrew (222) that passes through the locking sleeve (210) to releasably lock the vertical post (132) within the locking sleeve (210).

Figure 8:
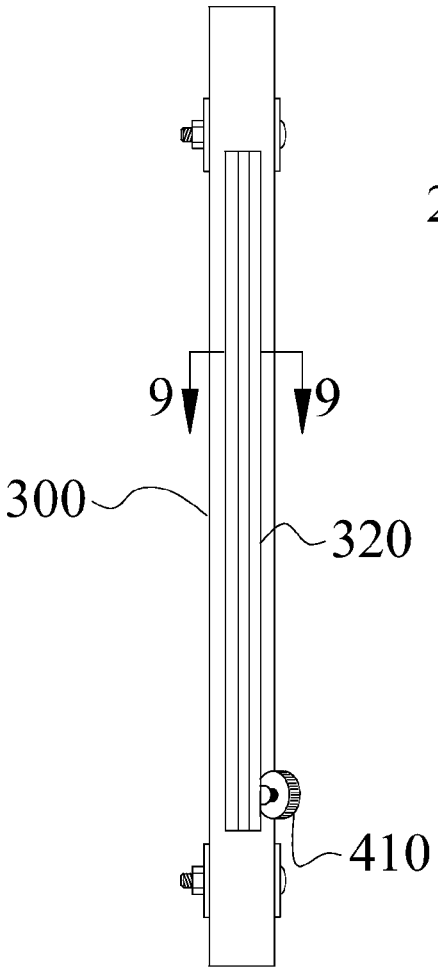
FIG. 8 shows a side elevation view of an embodiment of the external surface mount, not to scale.
Figure 9:
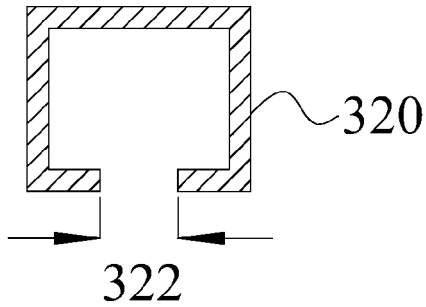
FIG. 9 shows a partial cross-sectional view taken along line 9-9 in FIG. 8, not to scale.

In embodiments where the height adjustment post (200) is joined to the vertical post (132) by mechanical fasteners or welding, the translation guide (320) should be configured accordingly. For example, if screws or bolts are used to join the height adjustment post (200) to the vertical post (132), the translation guide (320) may be formed with a slot (322), as seen in FIGS. 8-9, appropriately sized to receive the screws or bolts to enable the jump measurement device (100) to translate adjacent to an outer surface of the translation guide (320) as the height adjustment post (200) translates within the translation guide (320).

Figure 13:
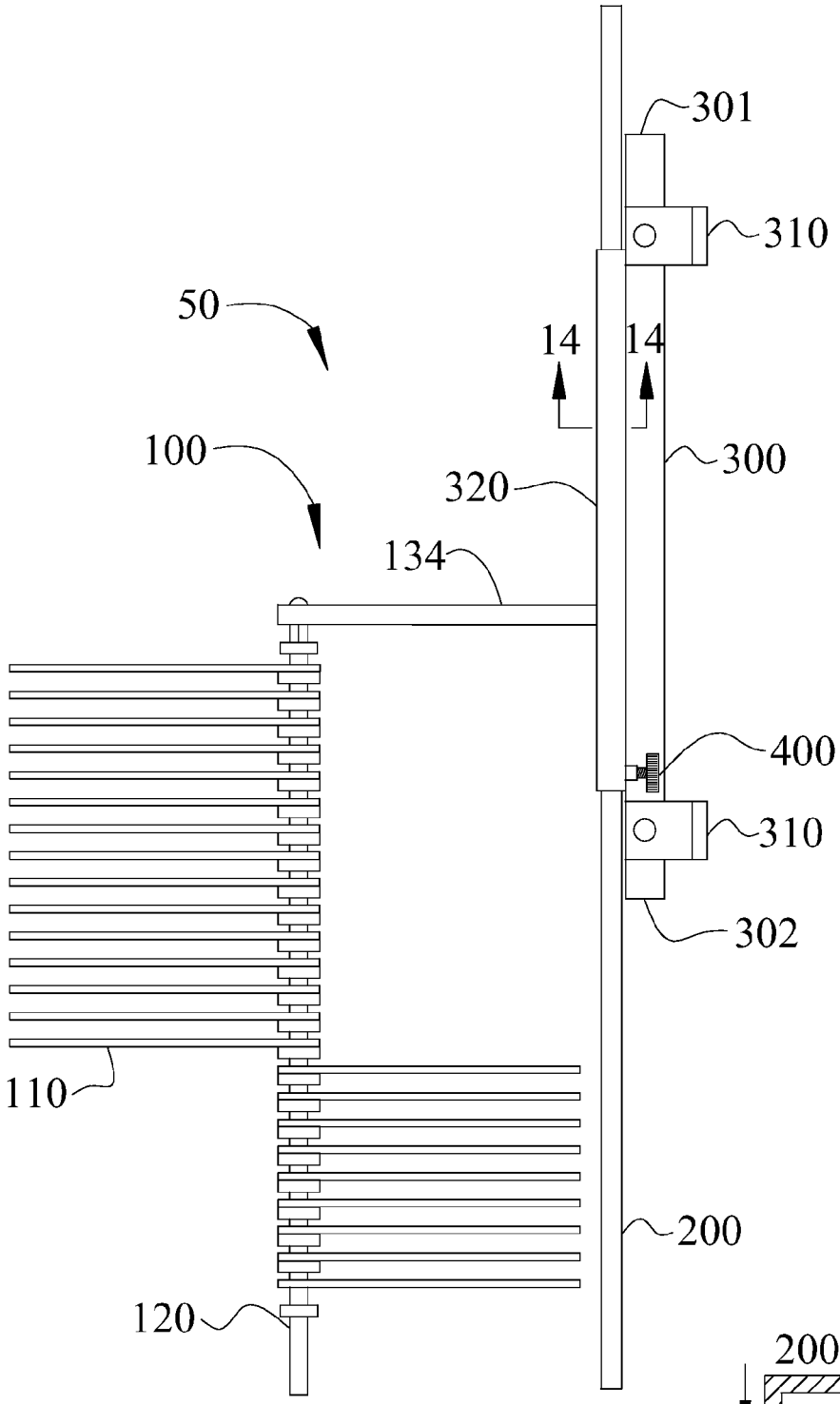
FIG. 13 shows an elevation view of an embodiment of the portable jump training apparatus, not to scale.
Figure 14:
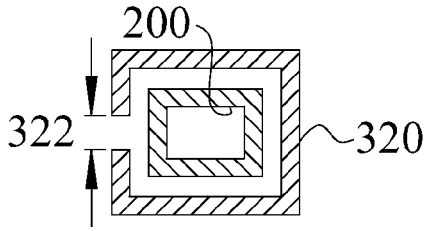
FIG. 14 shows a partial cross-sectional view taken along line 14-14 in FIG. 13, not to scale.

In an alternative embodiment, illustrated in FIG. 13, a vertical post (132) may not be required for joining the jump measurement device (100) to the height adjustment post (200). In this embodiment, the jump measurement device (100) may have at least one support arm (134), wherein the height adjustment post (200) is joined directly to the at least one support arm (134). The height adjustment post (200) may be joined to the at least one support arm (134) by any of the methods discussed above for joining the height adjustment post (200) to the vertical post (134). Thus, in this particular embodiment, the translation guide (320) should be configured to allow the at least one support arm (134) to translate freely with the height adjustment post (200). This may be accomplished by forming the translation guide (320) with a slot (322), as seen in FIG. 14, such that the translation of the jump measurement device (100) translational corresponds to the translation of the height adjustment post (200) within the translation guide (320).

The adjustability of the portable jump training apparatus (50) allows the vertical leaps of athletes of various abilities to be measured. For example, if the portable jump training apparatus (50) is releasably secured to a standard basketball backboard, as seen in FIG. 12, a range of several feet may be measured. Typically the protective padding covering the lower portion of the backboard extends about 6 inches to 12 inches above the 10 ft rim. The standard backboard used in high school, college, and professional basketball has a horizontal width of 6 ft and a vertical length of 3½ ft. Thus, in this example, the portable jump training apparatus (50) may be releasably secured to the backboard at a distance of 10½ ft from the ground. A typical jump measurement device (100) may be designed to measure a total vertical distance of 2 ft in ½ inch increments. A typical height adjustment post (200) may be about 4 ft to 6 ft in length to allow for adequate adjustability. Therefore, by utilizing the adjustability of the portable jump training apparatus (50), vertical heights of 9 ft to 11 ft, or 10 ft to 12 ft, or higher or lower may be accurately measured. Depending on the particular athlete's leaping ability, the vertical height of the jump measurement device (100) may easily be adjusted to achieve a range of measurement appropriate for the particular athlete.

When the appropriate measurement range is determined, the jump measurement device (100) may be set at a desired height by adjusting the height adjustment post (200) within the translation guide (320). In one embodiment, as seen in FIGS. 1 and 5, the translation guide (320) may include a height adjustment lock (400) to releasably secure the height adjustment post (200) within the translation guide (320) to lock the jump measurement device (100) at the desired height. The height adjustment lock (400) may include a setscrew (410) that passes through the translation guide (320) to releasably lock the height adjustment post (200) within the translation guide (320). In another embodiment, the height adjustment lock (400) may include a quick-release cam system (not shown) that releasably locks the height adjustment post (200) and the translation guide (320) in position by compression.

Referring now to FIGS. 10 and 11, an alternative embodiment of the portable jump training apparatus (50) is shown. In this embodiment, the height adjustment post (200) is configured to translate externally to the translation guide (320) instead of within the translation guide (320). As seen in FIG. 10, the translation guide (320) is joined to, yet spaced apart from, the external surface mount (300). To enable translation of the height adjustment post (200) about the translation guide (320), the height adjustment post (200) is formed with a slot (230), as seen in FIG. 11. The slot (230) may begin at a proximal end (202) of the height adjustment post (200) and may end at a distal end (201) of the height adjustment post (200). However, the slot (230) need not extend all the way to the distal end (201). Thus, in one embodiment, the slot (230) serves to prevent the height adjustment post (200) from falling to the ground when the height adjustment lock (400) is disengaged. As seen in FIG. 10, the height adjustment post (200) may further include a height adjustment lock (400) to releasably secure the height adjustment post (200) to the translation guide (320) to lock the jump measurement device (100) at a desired height.

Figure 2A:
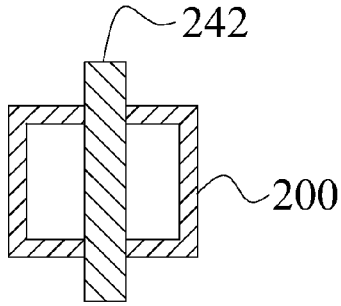
FIG. 2A shows a partial cross-sectional view taken along line 2A-2A in FIG. 1, not to scale.
Figure 6:
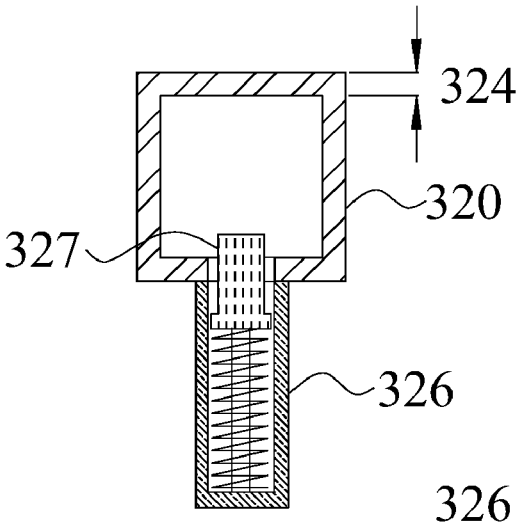
FIG. 6 shows a partial cross-sectional view taken along line 6-6 in FIG. 4, not to scale.

The portable jump training apparatus (50) may also be equipped with a number of safety enhancing features. In one embodiment of the instant invention, as seen in FIGS. 1 and 2A, the height adjustment post (200) may include a limit lock (240) to prevent the height adjustment post (200) from translating completely out of the translation guide (320) and potentially injuring someone or causing damage to the floor. For example, if for some reason the height adjustment lock (400) becomes accidentally disengaged, the limit lock (240) will prevent the height adjustment post (200) and the jump measurement device (100) from falling to the ground. The limit lock (240) may be constructed in a number of ways to prevent the height adjustment post (200) from translating completely out of the translation guide (320). For example, the height adjustment post (200) may be formed with a recess that is designed to accept a locking pin (242), as seen in FIG. 2A. The locking pin (242) extends beyond the walls of the translation guide (320) and prevents translation of the height adjustment post (200) beyond the location of the locking pin (242). Alternatively, the limit lock (240) may be formed as a shoulder or flange on the height adjustment post (200) that extends beyond the walls of the translation guide (320).

In yet another embodiment, as illustrated in FIGS. 3-6, the translation guide (320) may include a translation lock (326) to prevent the height adjustment post (200) from translating completely out of the translation guide (320) and causing potential harm to persons or property. The translation lock (326) may be configured to continuously apply compressive force on the height adjustment post (200) to overcome the gravitational force, thereby preventing unwanted translation of the height adjustment post (200). The translation lock (326) requires the height adjustment lock (400) (illustrated as a setscrew (410) in FIGS. 3-6) to be disengaged, and an intentional force applied to the height adjustment post (200) in order to adjust the height of the jump measurement device (100). In one embodiment, illustrated in FIG. 6, the translation lock (326) includes a biased cylinder (327) that continuously applies a compressive force on the height adjustment post (200). In addition, the cylinder (327) may incorporate a friction enhancing surface or other non-slip coating to increase the coefficient of friction of the cylinder surface to further prevent the height adjustment post (200) from translating completely out of the translation guide (320).

Another notable safety advantage of the portable jump training apparatus (50) of the instant invention relates to the mounting aspect. By mounting the portable jump training apparatus (50) to a suspended external mounting surface (10), such as a basketball backboard, there would be no hazards (e.g., stands or other types of support and anchoring devices) near the ground that could cause a potential injury to the athlete. Additionally, due to the compact design of the portable jump training apparatus (50), no component extends below 12 inches from the lowest vane (110). Thus, there is much less risk of an athlete being injured from an overhanging component.

In order to properly use the portable jump training apparatus (50) of the instant invention, a suitable external mounting surface (10) is needed. One ideal external mounting surface (10) is a basketball backboard, as illustrated in FIG. 12. However, a football goal post, a pole, a tall door (especially for small children), or any number of fixed supports may provide acceptable external mounting surfaces (10). To ensure that the portable jump training apparatus (50) is adequately secured to the external mounting surface (10), the at least one adjustable gripping device (310) may include friction enhancing surfaces to increase the coefficient of friction between the at least one adjustable gripping device (310) and the external mounting surface (10). For example, the friction enhancing surfaces may be textured rubber pads or a non-slip coating.

The portability of the portable jump training apparatus (50) is accomplished by utilizing lightweight and compact components. For example, the drawing figures show rectangular tubular components for the height adjustment post (200), the vertical post (132), the external surface mount (300), and the translation guide (320); however, one with skill in the art will appreciate that these components may be of virtually any cross-sectional geometry. The tubular components, however, help reduce the weight of the combined portable jump training apparatus (50). In addition, all of the components may be fabricated from lightweight materials, such as aluminum, aluminum alloys, and high-strength plastics, just to name a few. However, to ensure the durability of the portable jump training apparatus (50), the tubular components, especially the external surface mount (300), may be fabricated from sturdier, heavier materials, such as steel.

In addition to being lightweight, the jump measurement device (100), height adjustment post (200), and external surface mount (300) are compact and may be separable from one another. To achieve maximum adjustability, while at the same time allowing for adequate portability, the jump measurement device (100) and the external surface mount (300) may have lengths that are approximately half the length of the height adjustment post (200). For example, by utilizing a jump measurement device (100) and external surface mount (300) having lengths of 2 ft, the height adjustment post (200) would be the longest component at 4 ft. Thus, the portable jump training apparatus (50) would be easy to transport in the trunk of a compact car or the bed of a pickup truck, while only occupying a minimal amount of space.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

I claim:

1. A portable jump training apparatus (50) for releasably securing to an external mounting surface (10) to measure an athlete's vertical leap, comprising:

(i) a jump measurement device (100) having a plurality of vanes (110) rotatably mounted to a vane mounting post (120), a frame member (130) having a vertical post (132) and at least one support arm (134), wherein the vane mounting post (120) is joined to the at least one support arm (134);

(ii) a height adjustment post (200) joined to the vertical post (132), such that the height adjustment post (200) is spaced apart from the vertical post (132) a post separation distance (136);

(iii) an external surface mount (300) having at least one adjustable gripping device (310) to releasably secure the external surface mount (300) to the external mounting surface (10), and a translation guide (320) configured to slidably receive the height adjustment post (200) such that the jump measurement device (100) may translate adjacent an outer surface of the translation guide (320) as the height adjustment post (200) translates within the translation guide (320) so that the position of the jump measurement device (100) and the height adjustment post (200) may be adjusted with respect to the stationary external surface mount (300); and (iv) a height adjustment lock (400) for releasably locking the height adjustment post (200) to the translation guide (320) to lock the jump measurement device (100) at a desired height.

2. The portable jump training apparatus (50) according to claim 1, wherein the height adjustment lock (400) includes a setscrew (410) that passes through the translation guide (320) to releasably lock the height adjustment post (200) within the translation guide (320).

3. The portable jump training apparatus (50) according to claim 1, further including a locking sleeve (210) configured to join the vertical post (132) and the height adjustment post (200).

4. The portable jump training apparatus (50) according to claim 3, wherein the locking sleeve (210) includes a vertical post lock (220) to releasably secure the vertical post (132) within the locking sleeve (210).

5. The portable jump training apparatus (50) according to claim 4, wherein the vertical post lock (220) includes a setscrew (222) that passes through the locking sleeve (210) and releasably locks the vertical post (132) within the locking sleeve (210).

6. The portable jump training apparatus (50) according to claim 1, wherein the translation guide (320) is formed with a slot (322) configured to enable the jump measurement device (100) to translate externally to the translation guide (320) as the height adjustment post (200) translates within the translation guide (320).

7. The portable jump training apparatus (50) according to claim 1, further including at least two support arms (134).

8. The portable jump training apparatus (50) according to claim 1, wherein the at least one adjustable gripping device (310) includes a friction enhancing surface to increase the coefficient of friction between the at least one adjustable gripping device (310) and the external mounting surface (10) to further secure the external surface mount (300) to the external mounting surface (10).

9. The portable jump training apparatus (50) according to claim 1, further including at least two adjustable gripping devices (310), wherein at least one adjustable gripping device (310) is located near a distal end (301) of the external surface mount (300), and at least one adjustable gripping device (310) is located near a proximal end (302) of the external surface mount (300).

10. The portable jump training apparatus (50) according to claim 1, wherein the height adjustment post (200) is formed with an exterior friction reducing surface and the translation guide (320) is formed with an interior friction reducing surface such that the coefficient of friction between the height adjustment post (200) and the translation guide (320) is decreased to promote smooth translation between the height adjustment post (200) and the translation guide (320).

11. The portable jump training apparatus (50) according to claim 1, wherein the length of height adjustment post (200) is at least 2 times longer than the lengths of the jump measurement device (100) and the external surface mount (300).

12. The portable jump training apparatus (50) according to claim 1, wherein the translation guide (320) is a tube with a tube wall thickness (324) and the height adjustment post (200) translates within the translation guide (320) and the vertical post (132) translates adjacent an outer surface of the translation guide (320).

13. The portable jump training apparatus (50) according to claim 12, wherein the post separation distance (136) is approximately 1.05 to 1.25 times greater than the tube wall thickness (324).

14. The portable jump training apparatus (50) according to claim 1, wherein the translation guide (320) further includes a translation lock (326) configured to continuously apply compressive force on the height adjustment post (200) to counteract the gravitational force and to prevent the height adjustment post (200) from translating out of the translation guide (320) when the height adjustment lock (400) is disengaged.

15. The portable jump training apparatus (50) according to claim 1, wherein the height adjustment post (200) includes a limit lock (240) to prevent the height adjustment post (200) from translating out of the translation guide (320) and causing potential injury.

16. A portable jump training apparatus (50) for releasably securing to an external mounting surface (10) to measure an athlete's vertical leap, comprising:

(i) a jump measurement device (100) having a plurality of vanes (110) rotatably mounted to a vane mounting post (120), a frame member (130) having a vertical post (132) and at least one support arm (134), wherein the vane mounting post (120) is joined to the at least one support arm (134);

(ii) a height adjustment post (200) joined to the vertical post (132), such that the height adjustment post (200) is spaced apart from the vertical post (132) a post separation distance (136);

(iii) an external surface mount (300) having at least one adjustable gripping device (310) to releasably secure the external surface mount (300) to the external mounting surface (10), and a translation guide (320) formed as a tube with a tube wall thickness (324), wherein the translation guide (320) is configured to slidably receive the height adjustment post (200) such that the jump measurement device (100) may translate adjacent an outer surface of the translation guide (320) as the height adjustment post (200) translates within the translation guide (320) so that the position of the jump measurement device (100) and the height adjustment post (200) may be adjusted with respect to the stationary external surface mount (300); and (iv) a height adjustment lock (400) for releasably locking the height adjustment post (200) within the translation guide (320) to lock the jump measurement device (100) at a desired height.

* * * * *